United States Patent [19]

Stine

[11] 4,440,629

[45] Apr. 3, 1984

[54] HYDROCARBON HYDROCRACKING PROCESS

[75] Inventor: Laurence O. Stine, Western Springs, Ill.

[73] Assignee: UOP Inc., Des Plaines, Ill.

[21] Appl. No.: 417,320

[22] Filed: Sep. 13, 1982

[51] Int. Cl.[3] ..... C10G 47/28

[52] U.S. Cl. ..... 208/111; 208/108; 208/112; 208/164

[58] Field of Search ..... 208/111, 112, 108, 164, 208/153

[56] References Cited

U.S. PATENT DOCUMENTS

| | | | |
|---|---|---|---|
| 3,242,067 | 3/1966 | Arey, Jr. et al. | 208/112 |
| 3,412,013 | 11/1968 | Bowles | 208/164 |
| 3,838,039 | 9/1974 | Vesely et al. | 208/108 |
| 3,855,870 | 12/1974 | Hayes | 260/668 D |
| 3,932,269 | 1/1976 | Lehman | 208/111 |
| 3,956,104 | 5/1976 | Hilfman | 208/111 |
| 4,316,794 | 2/1982 | Schoennagel | 208/111 |

*Primary Examiner*—Delbert E. Gantz
*Assistant Examiner*—Anthony McFarlane
*Attorney, Agent, or Firm*—James R. Hoatson, Jr.; John G. Cutts, Jr.; William H. Page, II

[57] ABSTRACT

A process for the direct catalytic conversion of hydrocarbon oil is disclosed wherein the hydrocarbon feedstock, hydrogen and hot solid catalyst particles are contacted at a temperature from about 600° F. to about 995° F. to form a suspension in a riser reactor thereby producing lower boiling hydrocarbon components.

12 Claims, 1 Drawing Figure

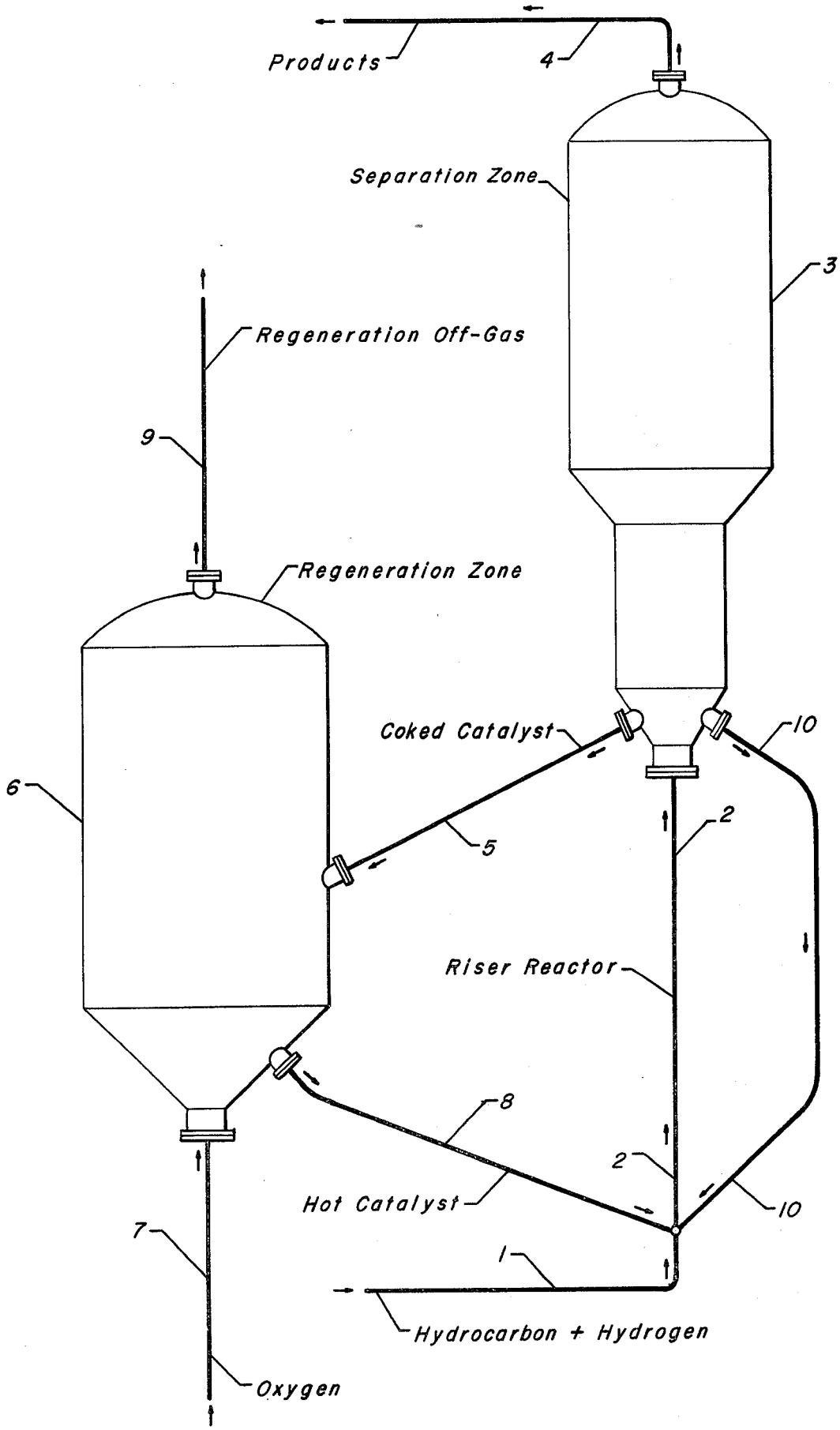
Products
4
Separation Zone
3
Regeneration Off-Gas
9
Regeneration Zone
Coked Catalyst
10
6
5
2
Riser Reactor
8
2
Hot Catalyst
10
7
1
Hydrocarbon + Hydrogen
Oxygen

HYDROCARBON HYDROCRACKING PROCESS

FIELD OF THE INVENTION

This invention concerns the direct hydroconversion of hydrocarbon feedstock to lower boiling components wherein the hydrocarbon feedstock is contacted with a circulating stream of catalyst and added hydrogen at a temperature from about 600° F. to about 995° F.

DESCRIPTION OF THE PRIOR ART

The catalytic conversion of hydrocarbon feedstocks to lower boiling components is well known and widely utilized in commercial oil refineries.

There are two basic modes for the catalytic conversion of hydrocarbon feedstock. The first mode is the catalytic conversion of hydrocarbons without the addition of hydrogen to the conversion zone and generally is conducted at a temperature of about 900° to 1025° F. with a circulating stream of catalyst. This mode, commonly referred to as fluid catalytic cracking (FCC), has the advantage of being performed at relatively low pressure, i.e., 50 psig or less while suffering the disadvantages of inherently being incapable of additionally upgrading the hydrocarbon product by the incorporation of added hydrogen and of relatively high reaction temperatures which accelerate the coke formation on the catalyst thereby decreasing the potentially greater volumetric yield of the normally liquid hydrocarbon product.

The second mode is the catalytic conversion of hydrocarbon feedstock with added hydrogen at reaction conversion temperatures less than about 1000° F. with the reaction zone comprising a fixed bed of catalyst. Although the fixed bed hydrocracking process, as the second mode is commonly known, has achieved commercial acceptance by petroleum refiners, this process has several disadvantages as hereinafter described. In order to attempt to achieve long runs and high on-stream reliability, fixed bed hydrocrackers require a high inventory of catalyst and a relatively high pressure reaction zone which is generally operated at 2000 psig or greater to achieve catalyst stability. Two phase flow of reactants over a fixed bed of catalyst often creates maldistribution within the reaction zone with the concomitant inefficient utilization of catalyst and incomplete conversion of the reactants. Momentary misoperation or electrical power failure can cause severe catalyst coking which may require the process to be shut down for catalyst regeneration or replacement.

A recent example of a hybrid hydrocarbon conversion process is disclosed in U.S. Pat. No. 4,316,794 (Schoennagel) wherein petroleum residual oil, hydrogen and hot solid catalyst particles are contacted in a riser reactor at a temperature of between about 1000° F. and 1800° F. This patent also claims that the spent solid catalyst particles are contacted with a mixture of oxygen-containing gas and steam in a fluidized bed operating in a partial oxidation mode to produce synthesis gas and regenerated gas. The hereinabove mentioned patent to Schoennagel is incorporated herein by reference thereto. The above process suffers under the relatively high reaction temperatures as previously described and the contacting of fluidized catalyst particles with steam at high temperatures is the classical technique for deactivating cracking catalysts.

In U.S. Pat. No. 3,856,870 (Hayes), a process for the dehydrogenation of hydrocarbons in the presence of a nonacidic catalytic composite is disclosed. Non-preferred methods for contacting the catalyst with the hydrocarbon in a dehydrogenation process are mentioned in the Hayes patent and include a moving bed system, a fluidized bed system or a batch type operation. This patent does not teach or suggest the hydrocracking of hydrocarbons in a cyclical reactor-regenerator fluidized bed system as hereinafter described.

U.S. Pat. No. 3,838,039 (Vesely et al) discloses a process for hydrocarbon conversion utilizing a continuous conversion and regeneration technique wherein a dense-phase, downwardly-moving bed of catalyst particles is contacted with a hydrocarbon reaction mixture. This patent does not teach or suggest the hydrocracking of hydrocarbons according to the sequence of steps recited in the present invention.

The present invention enables a high degree of flexibility and efficiency of operation of a catalytic hydrocracking process by the utilization of a circulating stream of catalyst, but which does not suffer the above shortcomings of the prior art processes.

SUMMARY OF THE INVENTION

Accordingly, the invention is, in one embodiment, a process for the hydrocracking hydrocarbon feedstocks to lower boiling components which comprises: (a) combining the hydrocarbon feedstock and hydrogen containing gas with hot solid catalyst particles, the weight ratio of catalyst to oil being within the range between 1 and 15, with hydrogen pressure being maintained within the range between 200 psig and 2000 psig, to form a suspension; (b) passing the suspension through a reaction zone at a temperature between about 600° F. and about 995° F. and providing a hydrocarbon residence time between about 1 second and 10 minutes; (c) separating and recovering the lower boiling components and the solid catalyst particles; (d) regenerating at least a portion of the separated solid catalyst particles with an oxygen-containing gas in a fluidized bed operating to produce a regenerated catalyst; and (e) returning at least a portion of the regenerated catalyst to combine with the hydrocarbon feedstock and hydrogen.

Other embodiments of the present invention encompass further details such as process streams, preferred hydrocarbon feedstocks, catalysts, and operating conditions, all of which are hereinafter disclosed in the following discussion of each of these facets of the invention.

BRIEF DESCRIPTION OF THE DRAWING

The drawing shows diagrammatically one embodiment of the present invention. More particularly a system is shown which comprises two vessels with interconnecting transfer conduits for effecting catalytic conversion of hydrocarbon feedstocks in the presence of hydrogen, regeneration of the hydrocarbon conversion catalyst and transfer of catalyst particles within the system. The above described drawing is intended to be schematically illustrative of the present invention and not be a limitation thereof.

DETAILED DESCRIPTION OF THE INVENTION

The feedstock for this invention may be any hydrocarbon feedstock such as, for example, naphtha, middle distillate, gas oil, vacuum gas oil, demetalized oil (DMO), whole crude, reduced crude or vacuum residuum. A particularly preferred hydrocarbon feedstock boils in the range of about 650° F. to about 1050° F.

Catalysts useful in the present invention contain active components which may be zeolitic or non-zeolitic. Non-limiting examples of non-zeolitic active components are amorphous silica-alumina, zirconia, silica-zirconia, etc. Representative crystalline zeolitic active components include zeolite A, zeolite X, zeolite Y, and synthetic mordenite, merely to name a few, as well as naturally occurring zeolites, including chabazite, faujasite, mordenite, and the like. Preferred crystalline zeolites include the synthetic faujasite zeolites X and Y, with particular preference being accorded to zeolite Y. Metals such as cobalt, tungsten, nickel, vanadium, molybdenum, platinum, palladium, copper, iron, etc. may be associated with the zeolitic or non-zeolitic active components.

Additionally, members of a novel class of zeolites characterized by a silica to alumina mole ratio of at least 12 and a constraint index in the approximate range 1 to 12 may be used directly as an active catalyst component or in combination with the aforementioned active components. This novel class of zeolites is exemplified by ZSM-5, ZSM-11, ZSM-12, ZSM-23, ZSM-35, and ZSM-38. These designations of zeolites are trade designations and are further described and defined in U.S. Pat. No. 4,316,794 (Schoennagel).

The crystalline zeolite employed as a constituent in the catalyst composition of the present invention is essentially characterized by a high catalytic activity. In general, the crystalline zeolites are ordinarily ion exchanged either separately or in the final catalyst form with a desired cation to replace alkali metal present in the zeolite as found naturally or as synthetically prepared. The exchange treatment is such as to reduce the alkali metal content of the final catalyst to less than about 1.5 weight percent and preferably less than about 0.5 weight percent. The purpose of ion exchange is to substantially remove alkali metal cations which are known to be deleterious to selective hydrocracking, as well as to introduce particularly desired catalytic activity by means of the various cations used in the exchange medium. For the hydrocracking process described herein, preferred cations are hydrogen, ammonium, rare earth and mixtures thereof. Ion exchange is suitably accomplished by conventional contact of the zeolite with a suitable salt solution of the desired cation such as, for example, the sulfate, chloride or nitrate.

It is preferred to have the crystalline zeolite of the catalyst in a suitable matrix, since this desired catalyst form is generally characterized by a high resistance to attrition, high activity and exceptional stability. Such catalysts are readily prepared by dispersing the crystalline zeolite in a suitable siliceous sol and gelling the sol by various means. The inorganic oxide which serves as the matrix in which the above crystalline zeolite is distributed includes silica gel or a cogel of silica and a suitable metal oxide. Representative cogels include silica-alumina, silica-magnesia, silica-zirconia, silica-thoria, silica-beryllia, silica-titania, as well as ternary combinations such as silica-alumina-magnesia, silica-alumina-zirconia and silica-magnesia-zirconia. Preferred cogels include silica-alumina, silica-zirconia or silica-alumina-zirconia. The above gels and cogels will generally comprise a major proportion of silica and a minor proportion of the other aforementioned oxide or oxides. Thus, the silica content of the siliceous gel or cogel matrix will generally fall within the range of 55 to 100 weight percent, preferably 60 to 95 weight percent, and the other metal oxide or oxides content will generally be within the range of 0 to 45 weight percent and preferably 5 to 40 weight percent. In addition to the above, the matrix may also comprise natural or synthetic clays, such as kaolin type clays, montmorillonite, bentonite or halloysite. These clays may be used either alone or in combination with silica or any of the above specified cogels in matrix formulation.

Where a matrix is used, content of crystalline zeolite, e.g., the amount of the zeolite Y component, is generally between about 5 to about 50 weight percent. Ion exchange of the zeolite to replace its initial alkali metal content can be accomplished either prior to or subsequent to incorporation of the zeolite into the matrix. The above compositions may be readily processed so as to provide fluid catalysts by spray drying the composite to form microspheroidal particles of suitable size. Catalyst particles are preferably less than about 200 microns in nominal diameter and more preferably less than about 100 microns. In contradistinction to the prior art of U.S. Pat. No. 4,316,794 (Schoennagel), the present invention conducts the hydrocracking of hydrocarbons with a fluidized catalyst system in the presence of hydrogen at a temperature from about 600° F. to about 995° F. The benefits to be realized by hydrocracking at a temperature from about 600° F. to about 995° F. in contradistinction to the Schoennagel patent are, for example, lower coke make on the catalyst, lower capital cost due to less exotic metallurgy required, greater yield of normally liquid hydrocarbon products, longer catalyst life, lower volumes of regeneration oxygen required and lower over-all hydrogen consumption.

The hydrogen consumed in the process of the present invention may be derived from any suitable source. For example, suitable sources of hydrogen are the hydrogen-rich off gas from the various dehydrogenation reactions effected in a catalytic reforming unit and the hydrogen produced in a traditional steam-reforming hydrogen plant.

Although the process of the present invention may appear to be superficially close to the Schoennagel patent, a substantially different process is envisioned which utilizes significantly less severe operating conditions than the prior art. In contradistinction to Schoennagel, I have discovered that utilizing lower temperature conversion conditions produces a more desirable product distribution and more favorable hydrogenation equilibrium, i.e., greater affinity of the hydrocarbon molecules of hydrogen. Furthermore, unlike Schoennagel, the present invention requires that water not be added to the catalyst regenerator because of the tendency of water (as steam) to deactivate the catalyst and my invention doesn't require the regenerator to be operated in a partial oxidation mode in the presence of steam.

The process concepts of the instant invention are considerably different from fluid catalytic cracking (FCC) operations in that hydrogen is employed in the reaction zone of the process of the present invention; the process of this invention is generally conducted at higher pressures than FCC operations; and the conversion zone temperatures of the present invention are generally less severe than those in FCC. Although the range of conversion zone temperatures of the present invention may seem to be just below the temperature ranges taught by the prior art including FCC, the difference is significant. The conversion of hydrocarbons into lower boiling hydrocarbons may proceed through either a catalytic mechanism or a thermal mechanism. Catalytic conversion of hydrocarbons, generally, may proceed at a wide variety of temperatures since the conversion is aided by catalysis. The thermal mechanism for the conversion of hydrocarbons in the presence of hydrogen doesn't begin to occur until an elevated temperature in the range from about 995° F. to about 1050° F. is reached and this temperature is dependent upon the type of hydrocarbon in question. Since thermal conversion consumes additional quantities of hydrogen and produces excess quantities of light hydrocarbon gases and coke which reduces the yield of normally liquid hydrocarbon products, the avoidance of thermal conversion is desirable. Therefore, the process of my invention is preferably conducted at a temperature from about 600° F. to about 995° F.

For best results, the hydrocarbon feedstock and the hydrogen are preferably intimately admixed before the hydrocarbon feedstock is contacted with the circulating catalyst. This permits the atomization of the hydrocarbon feedstock prior to its contact with the catalyst so as to obtain complete and uniform dispersion of the atomized hydrocarbon in relation to the circulating catalyst. The circulation rate of the catalyst is selected to sufficiently provide for the suitable distribution of the hydrocarbon feedstock upon the catalyst surface.

Without wishing to be bound thereby, it is believed that, at least theoretically, aromatic hydrocarbon molecules must be at least partially saturated with hydrogen before successful hydrocracking of the aromatic molecules may be conducted. Generally, the hydrogenation of hydrocarbons is more favorably conducted at a temperature somewhat less than suitable hydrocracking temperatures for a given feedstock. Therefore, according to my invention it is contemplated that the reactor riser may comprise different zones or stages which are maintained at the same or different temperature conditions. Hydrogenation and hydrocracking reactions are exothermic and therefore the temperature of the suspension traveling through the reactor riser tends to increase. Such a temperature increase may be sufficient to permit the desired combination of hydrogenation and hydrocracking of some selected feedstocks. Other feedstocks may because of their highly aromatic characteristics require additional adjustments of the temperature within the reactor riser. Depending upon the desired results, certain stages or zones within the reactor riser may have their respective temperatures increased or decreased. One method for increasing the temperature of a zone within the reactor riser and downstream (or upflow) of the feedstock inlet would be the introduction of additional hot, regenerated catalyst or additional hot hydrogen at the desired location. Regardless of the temperature profile within the reactor riser, the reactor riser temperature is maintained in any event at a temperature between about 600° F. and about 995° F.

As mentioned above, the catalyst containing coke-like material is regenerated by contacting the coked catalyst with an oxygen-containing gas in a fluidized bed regeneration zone. The amount of coke-like deposits on the catalyst depend upon the hydrocarbon feedstock, the operation conditions, and the type and quantity of catalyst circulated. The heat generated during the combustion of coke, as well as the exothermic heat of reaction during hydrocracking, may be used to raise the temperature of the catalyst and any excess heat may optionally be recovered for other purposes. Excess heat recovery may be conducted with the utilization of heat exchangers such as catalyst coolers, for example, located either internally or externally with respect to the regenerator. For example, a steam generator may be heated by a hot, flowing stream of regenerated catalyst.

The combustion of coke from catalyst containing coke may be performed in any suitable manner. Combustion conditions including temperature, oxygen concentration, circulation rate, fluidization degree and residence time may be selected to yield gaseous combustion products which comprise essentially carbon monoxide, essentially carbon dioxide or a combination of carbon monoxide and carbon dioxide. Any hydrogen present during combustion will produce water vapor and this water is in addition to the hereinabove mentioned combustion products. A gaseous stream rich in carbon monoxide may be removed from the process of the present invention and burned in a CO boiler to recover additional heat values. Where environmental concerns dictate the minimization of the release of carbon monoxide to the atmosphere, complete combustion of coke to carbon dioxide may be desirable.

Referring now to the drawing, by way of example, there is shown a side-by-side reactor-regenerator system. Feedstock, namely vacuum gas oil having a boiling range from about 850° F. to about 1050° F., and hydrogen containing gas, is fed via conduit 1 to riser reactor 2 for admixture and intimate contact with a large amount of hot, solid catalyst particles introduced by conduit 8 to form a suspension having a temperature in the range of about 600° F. to about 995° F. Catalyst to oil ratios may be preferably maintained within the range of between about 0.5 and 15, more preferably from between about 1 and about 15. The hydrogen pressure is preferably maintained within the range of from about 200 psig to about 3000 psig and more preferably from about 200 psig to about 2000 psig. The hydrogen charged in admixture with the hydrocarbon feedstock is present in an amount from about 100 standard cubic feet per barrel of hydrocarbon feedstock (SCFB) to about 25,000 SCFB, preferably from about 500 SCFB to about 20,000 SCFB and more preferably from about 500 SCFB to about 15,000 SCFB. The hot active catalyst particles catalytically sever the large hydrocarbon molecules contained in the feedstock and the resulting fragments are contacted with the surrounding hydrogen to yield hydrogenated hydrocarbon molecules having smaller molecular weights. The temperature rise of the hydrocarbon fluid within the riser reactor 2 is very rapid and is desirably at about 500° F. per second or more until the desired reaction zone temperature is achieved. This heat-up rate may be varied, however, depending upon the temperature of the feedstock and the temperature of the regenerated catalyst solids, as well as the catalyst to oil ratio employed. Hydrocracking reactions are generally exothermic in nature, and an increasing temperature gradient will be experienced as the hydrogen and hydrocarbon feedstock react during the passage through the riser reactor 2. It is desirable and preferable to maintain the maximum temperature achieved in riser reactor 2 below about 995° F. Depending on the particular operating conditions employed, considerable reduction in the average molecular weight of the hydrocarbon feedstock can be achieved. In addition, desulfurization and denitrogenation of the hydrocarbon feedstock will also occur in the riser, thereby producing a relatively clean product. The oil residence time in the reactor is preferably within the range of about 1 second to about 20 minutes, more preferably from about 1 second to about 10 minutes.

The means used to separate the products from the coked catalyst is located at the top of the riser reactor 2, in separation zone 3, and such means may include any suitable means known in the prior art such as, for example, cyclones. The hydrocarbon products and unreacted hydrogen are withdrawn from the separation zone 3 through conduit 4.

The catalyst containing coke deposits from hydrocracking the hydrocarbon feedstock, pass from the separation zone 3 through conduit 5 to a regeneration zone 6. In the regeneration zone 6, the coked catalyst comes into contact with a stream of oxygen-containing gas, e.g., pure oxygen or air which enters the regeneration zone 6 via conduit 7. The regeneration zone 6 operates as a fluidized bed to produce a regeneration off-gas comprising combustion products which is withdrawn through conduit 9. The temperature in the regeneration zone 6 is preferably maintained within the range of about 800° F. to about 1500° F., and preferably is sufficiently high to heat the catalyst so that the hot catalyst can in turn supply at least some of the energy to heat the hydrocarbon feed to the desired reaction temperature from about 600° F. to about 995° F. The hot regenerated catalyst then passes from regeneration zone 6 through conduit 8 to the bottom portion of the riser reactor 2 for admixture with the hydrocarbon feedstock and hydrogen as mentioned hereinbefore.

Optionally, a slipstream of unregenerated catalyst (catalyst containing coke deposits) from separation zone 3 may be passed via conduit 10 to riser reactor 2. The purpose of recycling unregenerated catalyst to the reactor riser is to supply additional catalyst and/or heat to the riser. The unregenerated catalyst will always be a source of heat and in the event that a certain mode of hydrocracking is experiencing a low coke generation per pass of catalyst, this so-called unregenerated catalyst will also act as a satisfactory source of active catalyst. Any quantity of catalyst contained in a slipstream as above described is to be included in any consideration or calculation of the catalyst to oil weight ratio of the present invention.

The following illustrative embodiment is presented to illustrate the process of the invention and is not intended as an undue limitation on the generally broad scope of the invention as set out in the appended claims.

ILLUSTRATIVE EMBODIMENT

This illustration describes a preferred embodiment of the present invention.

The selected feedstock is a vacuum gas oil/demetallized oil blend having a volumetric ratio of 75/25. This feedstock has a gravity of 20° API, an initial boiling point of 502° F., a 50% boiling point of 919° F. and a 90% boiling point of greater than about 1050° F. The feedstock contains 2.75 weight percent sulfur and 0.14 weight percent nitrogen.

A stream in the amount of 27,766 barrels per day of fresh feed is introduced at the bottom of the riser reactor in admixture with hydrogen in an amount of 10,875 standard cubic feet per barrel (SCFB) of feedstock. The feedstock and hydrogen is then contacted with a finely divided catalyst comprising zeolite Y in a weight ratio of catalyst to oil of about 4. The catalyst is a silica-alumina cogel comprising about 20 weight percent zeolite Y and the catalyst particles are less than about 100 microns in nominal diameter. The riser reactor is maintained at a maximum temperature of 875° F. and a minimum pressure of 1200 psig. The average residence time of the feedstock in the riser reactor is 20 seconds. After the reactants and catalyst have traversed the riser reactor, the reaction products are separated from the catalyst particles in a cyclone system comprising two stages. The recovered catalyst is passed to a regeneration zone wherein the coked catalyst is contacted with air in a fluidized bed to produce a regeneration off-gas comprising combustion products and a regenerated catalyst. The regeneration zone is maintained at a temperature of about 1150° F. At least a portion of the regenerated catalyst is then passed to the riser reactor for admixture with the hydrocarbon feedstock and hydrogen as mentioned hereinbefore.

The recovered reaction products are recovered in fractionation facilities and a summary of the product yields is presented in Table I.

TABLE I

SUMMARY OF PRODUCT YIELDS

| | Weight Percent |
|---|---|
| Chargestock | |
| Fresh Feed | 100 |
| Hydrogen | 3 |
| Total | 103 |
| Products | |
| Ammonia | 0.2 |
| Hydrogen Sulfide | 2.9 |
| Light Gaseous Hydrocarbons | 6.0 |
| Light & Heavy Naphtha | 45.8 |
| Kerosene | 17.7 |
| Light Diesel Oil | 11.5 |
| Heavy Diesel Oil | 16.9 |
| Coke | 2.0 |
| Total | 103.00 |

The foregoing illustrative embodiment, description, and drawing demonstrate the method by which the present invention is effected and the benefits afforded an improved hydrocracking process for the conversion of hydrocarbonaceous charge stock.

I claim:

1. A process for hydrocracking hydrocarbon feedstocks to lower boiling components which comprises:

(a) combining said hydrocarbon feedstock and hydrogen containing gas with hot solid zeolitic active catalyst particles, the weight ratio of catalyst to oil being within the range between 1 and 15, with hydrogen pressure being maintained within the range between 200 psig and 2000 psig, to form a suspension;

(b) passing said suspension through a riser reaction zone at a temperature between about 600° F. and less than 1000° F. to catalytically crack said feedstock while avoiding thermal conversion of said feedstock and providing a hydrocarbon residence time between about 1 second and 10 minutes;

(c) separating and recovering said lower boiling components and said solid catalyst particles;

(d) regenerating at least a portion of the separated solid catalyst particles with a water-free oxygen-containing gas in a fluidized bed operated at conditions to produce regenerated catalyst and gaseous products consisting essentially of carbon monoxide and carbon dioxide; and (e) returning at least a portion of the regenerated catalyst combined with the hydrocarbon feedstock and hydrogen.

2. The process of claim 1 wherein said hydrocarbon feedstock comprises vacuum gas oil.

3. The process of claim 1 wherein said hydrocarbon feedstock comprises reduced crude.

4. The process of claim 1 wherein said hydrocarbon feedstock comprises demetalized oil.

5. The process of claim 1 wherein said hydrocarbon feedstock comprises whole crude.

6. The process of claim 1 wherein said catalyst particles comprise a zeolitic matrix.

7. The process of claim 1 wherein said oxygen-containing gas is air.

8. The process of claim 1 wherein step (d) is conducted at a temperature from about 800° F. to about 1500° F.

9. The process of claim 1 wherein said catalyst particles are less than 200 microns in nominal diameter.

10. The process of claim 1 wherein said hydrogen is present in an amount from about 500 to about 20,000 standard cubic feet per barrel of hydrocarbon feedstock.

11. The process of claim 1 wherein said catalyst particles comprise a metal component.

12. The process of claim 11 wherein said metal component is cobalt, tungsten, nickel, vanadium, molybdenum, platinum, palladium, copper, iron or a compound thereof.

* * * * *